US006468126B1

(12) United States Patent
Herber

(10) Patent No.: US 6,468,126 B1
(45) Date of Patent: Oct. 22, 2002

(54) POP-UP DEVICE

(76) Inventor: Paul Herber, 1600 Driskill Dr., Irving, TX (US) 75038

( * ) Notice: Subject to any disclaimer, the term of this patent is extended or adjusted under 35 U.S.C. 154(b) by 0 days.

(21) Appl. No.: 09/800,200

(22) Filed: Mar. 6, 2001

(51) Int. Cl.[7] ..... A63H 13/16

(52) U.S. Cl. ..... 446/310; 446/308; 446/309; 446/475; 446/486; 472/51

(58) Field of Search ..... 446/308–312, 446/475, 5, 486; 472/51–53

(56) References Cited

U.S. PATENT DOCUMENTS

| | | | | | |
|---|---|---|---|---|---|
| 2,003,765 | A | * | 6/1935 | Widen | 446/310 |
| 2,159,115 | A | | 5/1939 | Vogel, Jr. | |
| 2,406,777 | A | | 9/1946 | Koretzky | |
| 2,811,030 | A | | 10/1957 | Tannahill | |
| 3,037,779 | A | * | 6/1962 | Duncan | 446/310 |
| 3,088,302 | A | | 5/1963 | Koch | |
| 3,240,035 | A | | 3/1966 | Anderson | |
| 3,586,320 | A | * | 6/1971 | Mace | 116/215 |
| 3,604,825 | A | | 9/1971 | Leshko | |
| D256,844 | S | | 9/1980 | Conn | |
| 4,407,504 | A | * | 10/1983 | Popov | 446/310 |
| 4,453,340 | A | * | 6/1984 | Kozuka et al. | 446/310 |
| 4,721,455 | A | | 1/1988 | Barfus | |
| D298,859 | S | | 12/1988 | Crisci | |
| 5,057,005 | A | | 10/1991 | Kwok | |
| 5,673,802 | A | | 10/1997 | Valentino | |
| 5,683,239 | A | | 11/1997 | Cardosi | |
| D388,197 | S | | 12/1997 | Cardosi | |
| 5,713,778 | A | * | 2/1998 | Radosevich et al. | 446/304 |
| 6,262,352 | B1 | * | 7/2001 | Liu | 446/309 |

* cited by examiner

*Primary Examiner*—Derris H. Banks
*Assistant Examiner*—Bena B. Miller
(74) *Attorney, Agent, or Firm*—Darin M. Klemchuk; Matthew S. Anderson; Thompson & Knight LLP

(57) ABSTRACT

The invention is a pop-up device adapted to allow for a number of triggering means and a number of special effects upon triggering of the device. The pop-up device may be placed in a hollow section of a cake, which is later iced over so that the candle holder is not visible. In the preferred embodiment, the base of the device supports the pop-up mechanism within a housing. The device is held in a compressed state by a release mechanism. Upon triggering of the release mechanism, the device is released and pushed through the cake or other confection, thereby providing surprise and entertainment. In alternative embodiments, the device is actuated by a drive mechanism or a fuse.

36 Claims, 11 Drawing Sheets

POP-UP DEVICE

FIELD OF THE INVENTION

The present invention relates to dynamic pop-up toys and novelties such as spring-loaded and motor-driven devices. The present invention also relates to candle holders for candles such as those used on a birthday cake or other confection.

BACKGROUND OF THE INVENTION

Pop-up toys are known in the art. These toys are typically spring-activated to appear unexpectedly. However, they do not provide for a variety of control means and functions, and are not adapted to being inserted into a cake, other confection, or other decoration. One application for pop-up toys is for use in conjunction with cake decorations. Cake decorations and decorative candle holders used for securing candles to birthday cakes are also known in the art. Typically, a cake decoration either sits atop the cake or other confection and is secured using icing or penetrates the cake and remains static. While some of these cake decorations may be removed from the cake for use as souvenirs, none of the known decorations appear unexpectedly. What is needed, therefore, is device that functions both as a cake decoration and a pop-up toy.

SUMMARY OF THE INVENTION

The invention is a pop-up device adapted to allow for a number of triggering means and a number of special effects upon triggering of the device. The pop-up device may be placed in a hollow section of a cake, which is later iced over so that the candle holder is not visible. In the preferred embodiment, the base of the device supports the pop-up mechanism within a housing. The device is held in a compressed state by a release mechanism. Upon triggering of the release mechanism, the device is released and pushed through the cake or other confection, thereby providing surprise and entertainment. In alternative embodiments, the device is actuated by a drive mechanism or a fuse.

The present invention provides for both spring-activated and motor-driven pop-up devices, which may be triggered by a variety of inputs, including a release line, a remote control, radio-frequency transmitting device, an infra-red transmitting device, a sonic-frequency transmitting device, and other triggering sources. Upon triggering, the invention provides for a number of special effects in addition to the emergence of a pop-up figurine. These effects include unexpected sounds, lights, glitter, rotating toys, and the like.

The present invention, therefore, seeks to add excitement to parties or events by providing a dynamic candle holder that can be activated to surprise and entertain guests. The present invention may also be used in a birthday cake, other confection, or other decoration without incorporating a candle holder.

DESCRIPTION OF THE DRAWINGS

Other objects, advantages, features, and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE PREFERRED EMBODIMENT

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical, and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
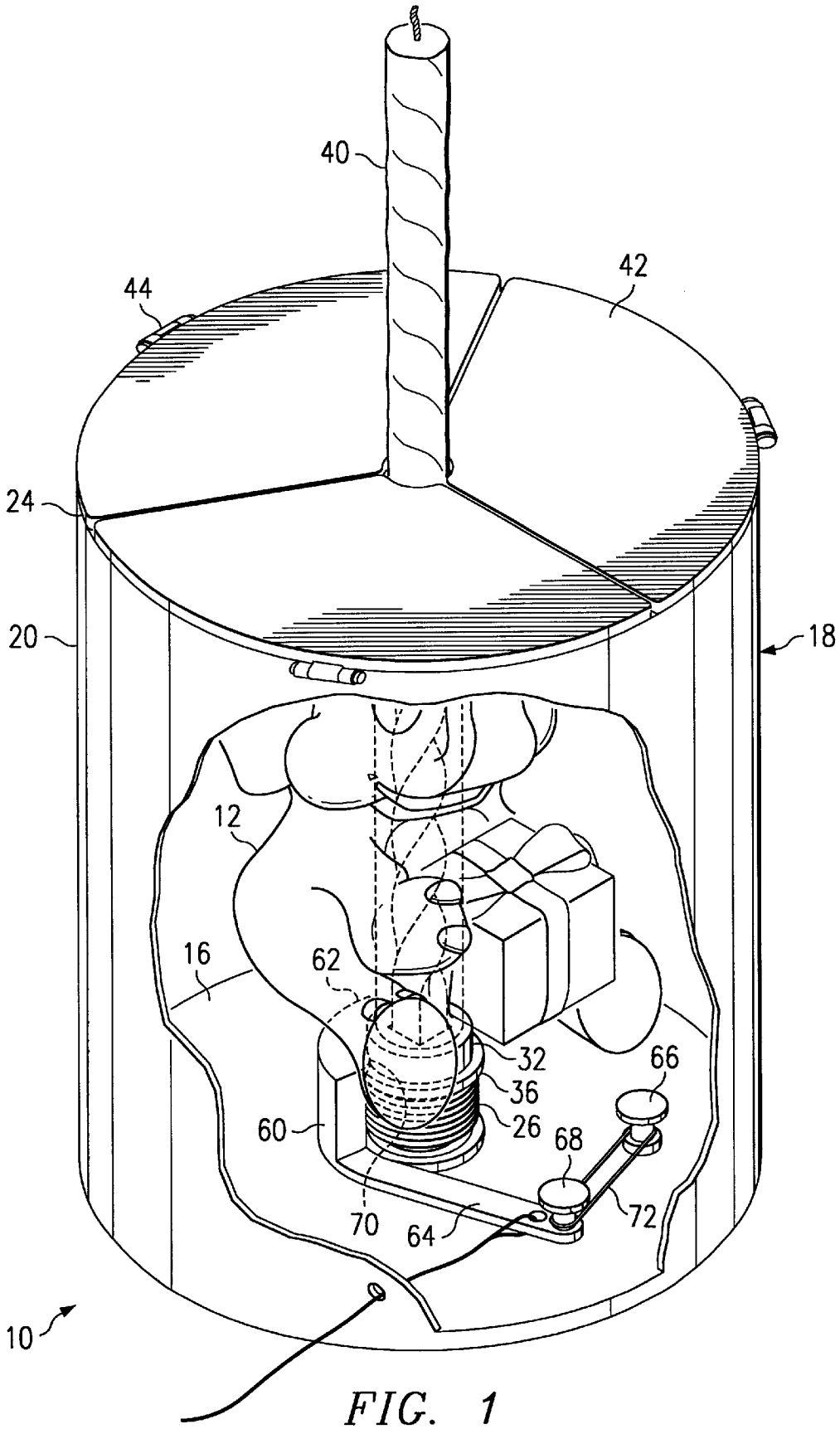
FIG. 1 is a perspective view of the pop-up device in the compressed state.
Figure 2:
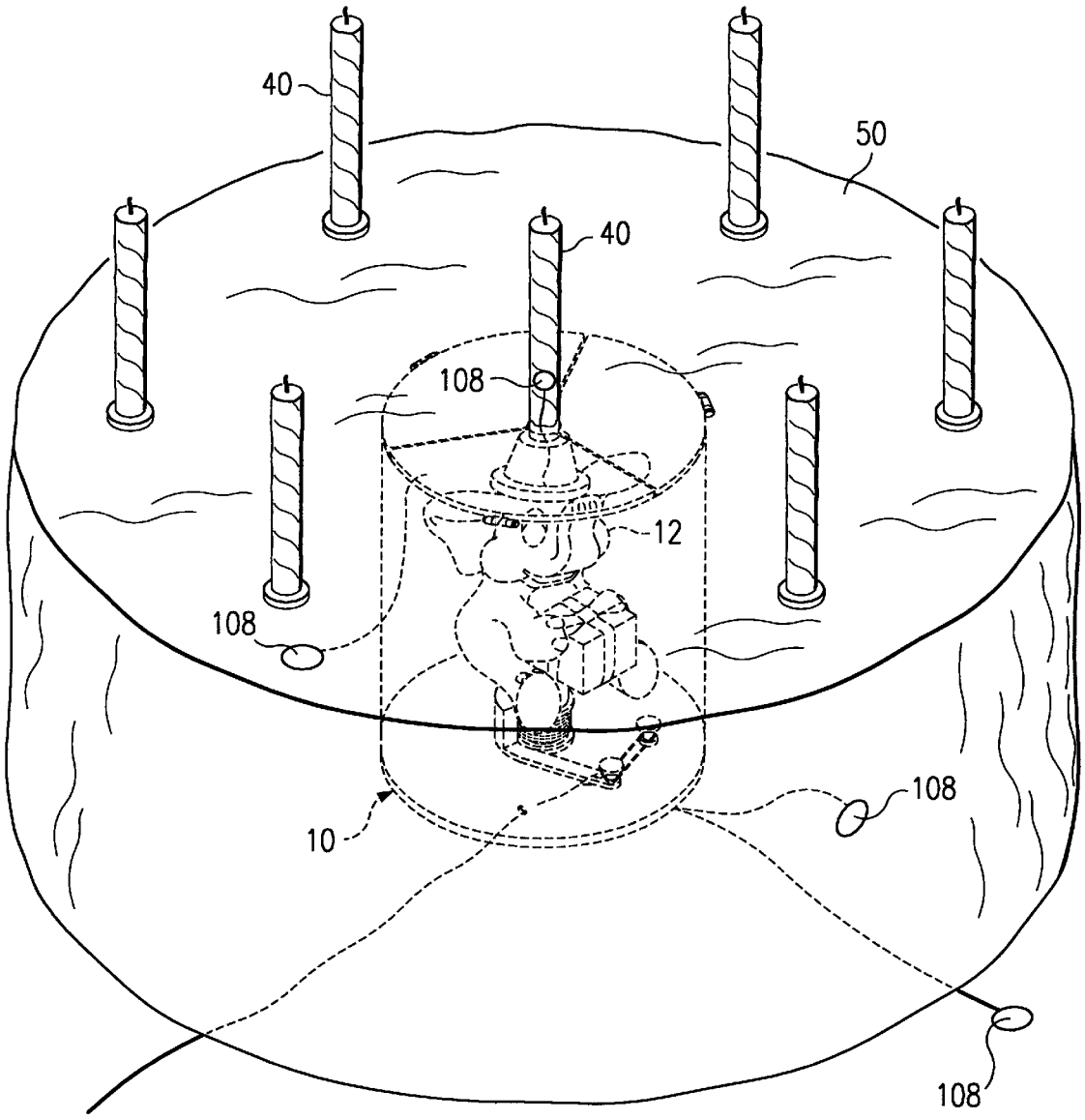
FIG. 2 is a perspective view of the pop-up device in the compressed state inserted in a cake with the device and optional sensors shown in phantom line.

FIG. 1 shows a frontal view of the pop-up device [10] in its compressed state. FIG. 2 depicts the pop-up device [10] in its compressed state while inserted in a cake [50] with the pop-up device [10] and optional sensors [108] shown in phantom line. Although not necessarily required, housing may be placed around the device to shield the figurine [12] from the cake or other confection. FIG. 1 illustrates the housing [18], which attaches to the base [16] to shield the figurine [12] from the cake [50] (shown in FIG. 2). The figurine [12] may be shaped to resemble a person, object, or other suitable design. For example, the figurine [12] could be shaped like a children's cartoon character, a football player, or a well-known political figure. The figurine [12] can be retained for use as a toy or collectible item after its use as a pop-up device.

The housing [18] and base [16] are preferably rounded and designed to fit easily in the center of a cake or other confection or baked item. The housing [18] and base [16], however, could be any shape, provided that either the cake is baked with an open space for the housing [18] and the base [16] or a part of the cake is removed in order to accommodate them. The appropriate amount of cake may be removed using an auger, knife, or similar device. A special pan, such as one used for a Bundt cake, can also be used that forms the cake without a central section. The wall [20] of the housing [18] protects the figurine [12] from the surrounding cake [50]. Icing may be placed on top of the cake [50] covering the top [22] (not shown) of the housing [18] so that it is indistinguishable from the rest of the cake [50]. A candle [40] may be inserted through the housing and secured within the figurine [12]. The figurine [12] preferably includes a central hollow section to allow insertion of the candle [40] through the figurine [12].

Figure 3:
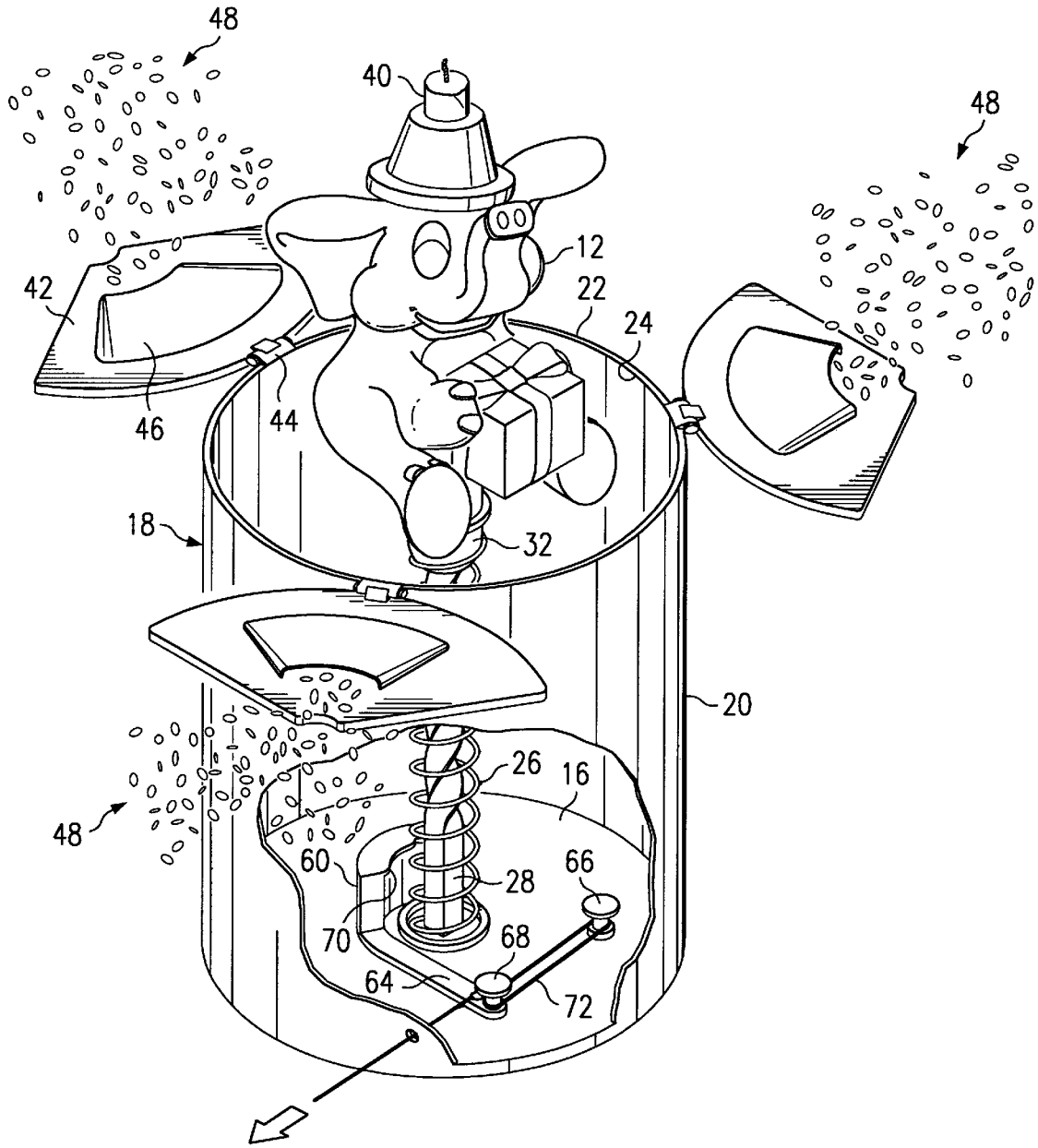
FIG. 3 is a perspective view of the pop-up device in the decompressed state illustrating optional flap retention pockets and glitter.

FIG. 1 illustrates the figurine in the compressed state with one embodiment of the release mechanism [60] depicted. Turning to FIG. 3, the figurine [12] is attached to a mounting sleeve [32]. The mounting sleeve [32] is held by the release mechanism [60] in the compressed state. As the mounting sleeve [32] is released, it and the figurine [12] are pushed up the rod [28] by spring [26] to pop open the top [22] of the housing [18]. The top [22] (not shown) is preferably composed of three flaps [42], which are attached via hinges [44] to the rim [24] of the housing [18]. The wall [20] of the housing, therefore, meets the top [22] at the rim [24]. Although three flaps [42] are shown in FIGS. 1 and 3, any number of flaps, hinging devices, or like structure could be used. The top [22], like the housing [18], is preferably constructed out of plastic, but any lightweight material such as nylon, styrene, and like could be used. The top [22] should be either movable or perforable to allow the figurine [12] to pop easily out of the housing [18].

FIG. 3 depicts an alternative embodiment of the flaps [42]. The pop-up device in FIG. 3 is shown in the decompressed state with flaps [42] open. Flaps [42] may be optionally modified to include retention pockets [46], which retain lightweight matter such as edible glitter and the like, while the device is in the compressed state. As the figurine [12] pops through the cake [50], the rotating action of flaps [42] will release the material [48] stored in the retention pockets [46] over the cake [50], thereby adding further surprise and entertainment. One skilled in the art will recognize that the retention pockets [46] can be constructed of any a lightweight material such as plastic, nylon, styrene, and the like.

Figure 4:
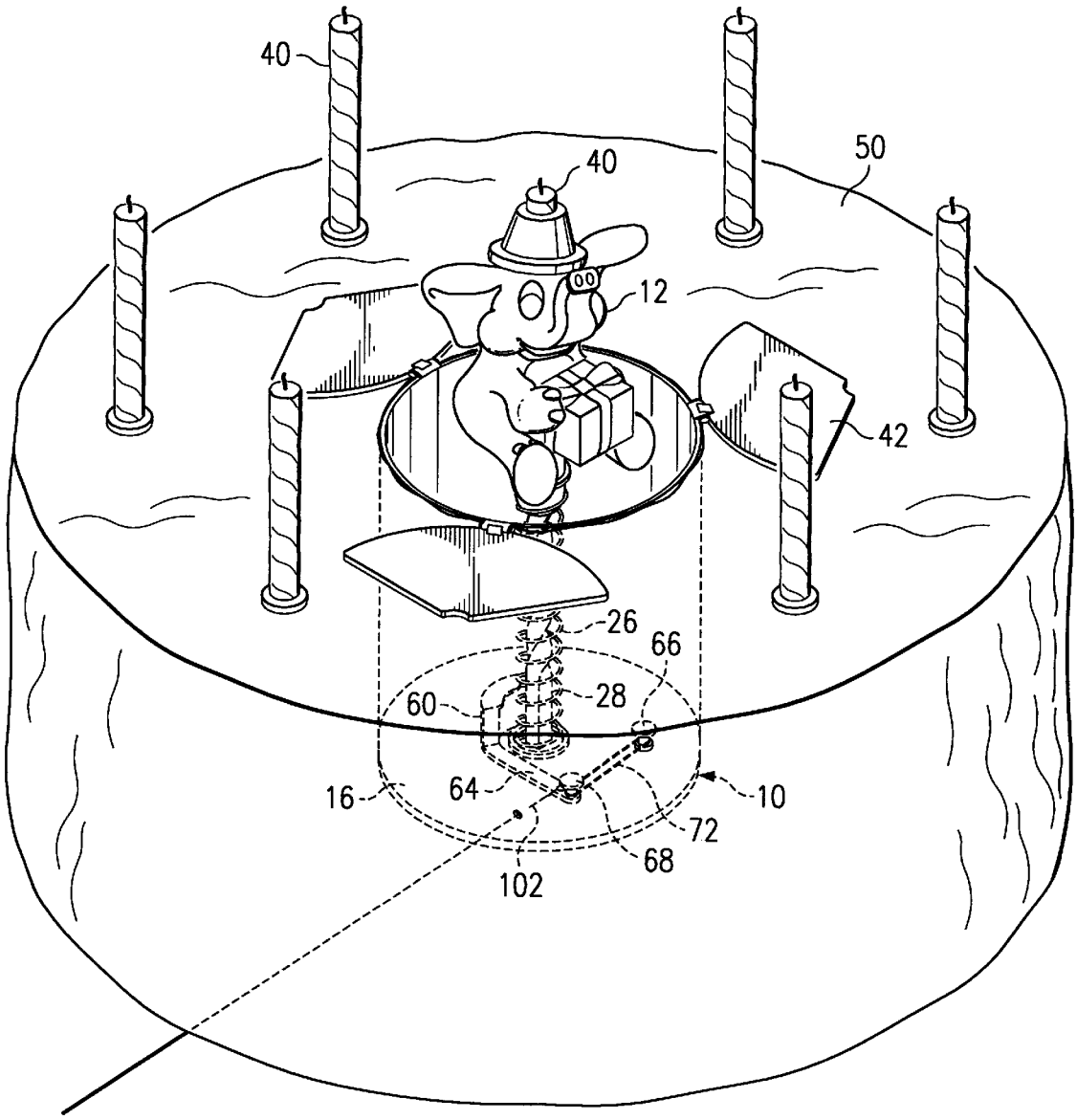
FIG. 4 is a perspective view of the pop-up device in the decompressed state while inserted in a cake with the device shown in phantom line.
Figure 5:
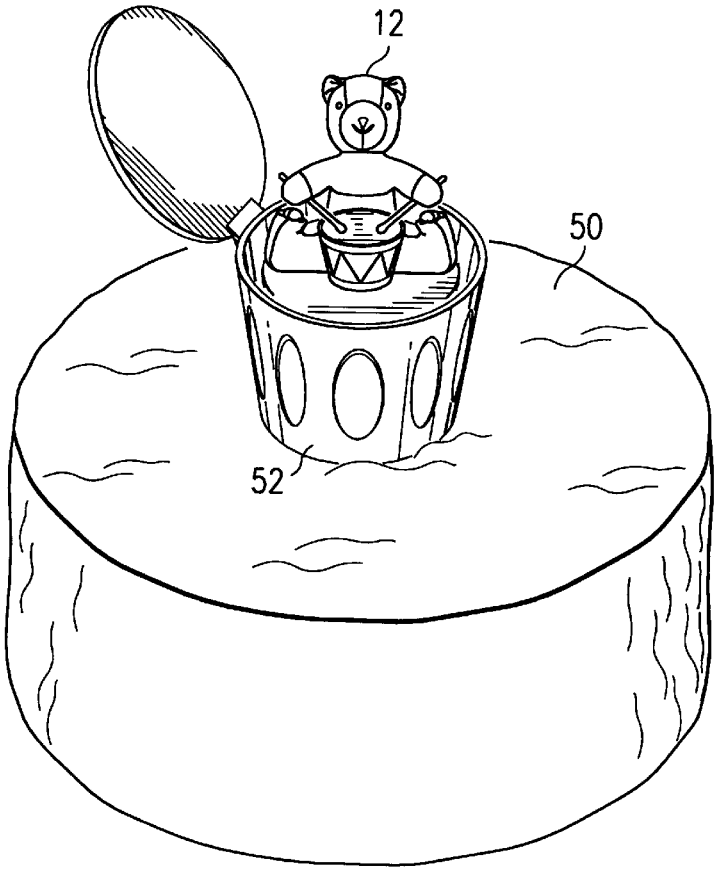
FIG. 5 is a perspective view of an alternative embodiment of the pop-up device in the decompressed state illustrating the figurine popping out of a decoration on the cake.

FIG. 4 depicts the figurine [12] in its decompressed state while inserted in a cake [50] with the remainder of the pop-up device [10] shown in phantom line. FIG. 5 shows an alternative embodiment of the pop-up device. In this embodiment, figurine [12] pops out of a decoration [52] placed upon cake [50] rather than popping out of the cake directly. One skilled in the art will appreciated that the components of the pop-up device discussed in more detail below can be modified to allow for and enhance popping out of the decoration [52].

FIG. 3 shows the decompressed spring [26] threaded along the rod [28]. In the compressed state, as shown in FIGS. 1 and 2, the rod [28] is hidden from view within the figurine [12]. However, upon activation of the trigger mechanism [100] (not shown) and subsequent release of the mounting sleeve [32], the mounting sleeve [32] is pushed up the rod [28] by the spring [26]. FIGS. 1 and 3 illustrate the mounting sleeve [32], release mechanism [60], and spring [26].

Figure 7:
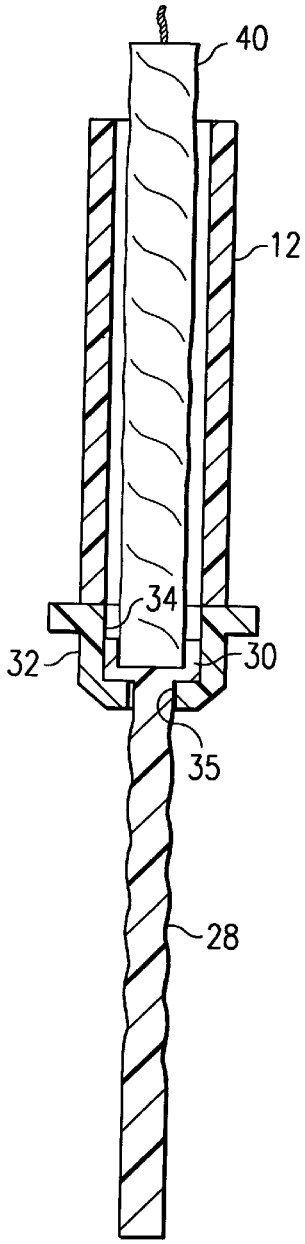
FIG. 7 is a cut-away side view of the pop-up device in the decompressed state taken along line x—x of FIG. 6.
Figure 6:
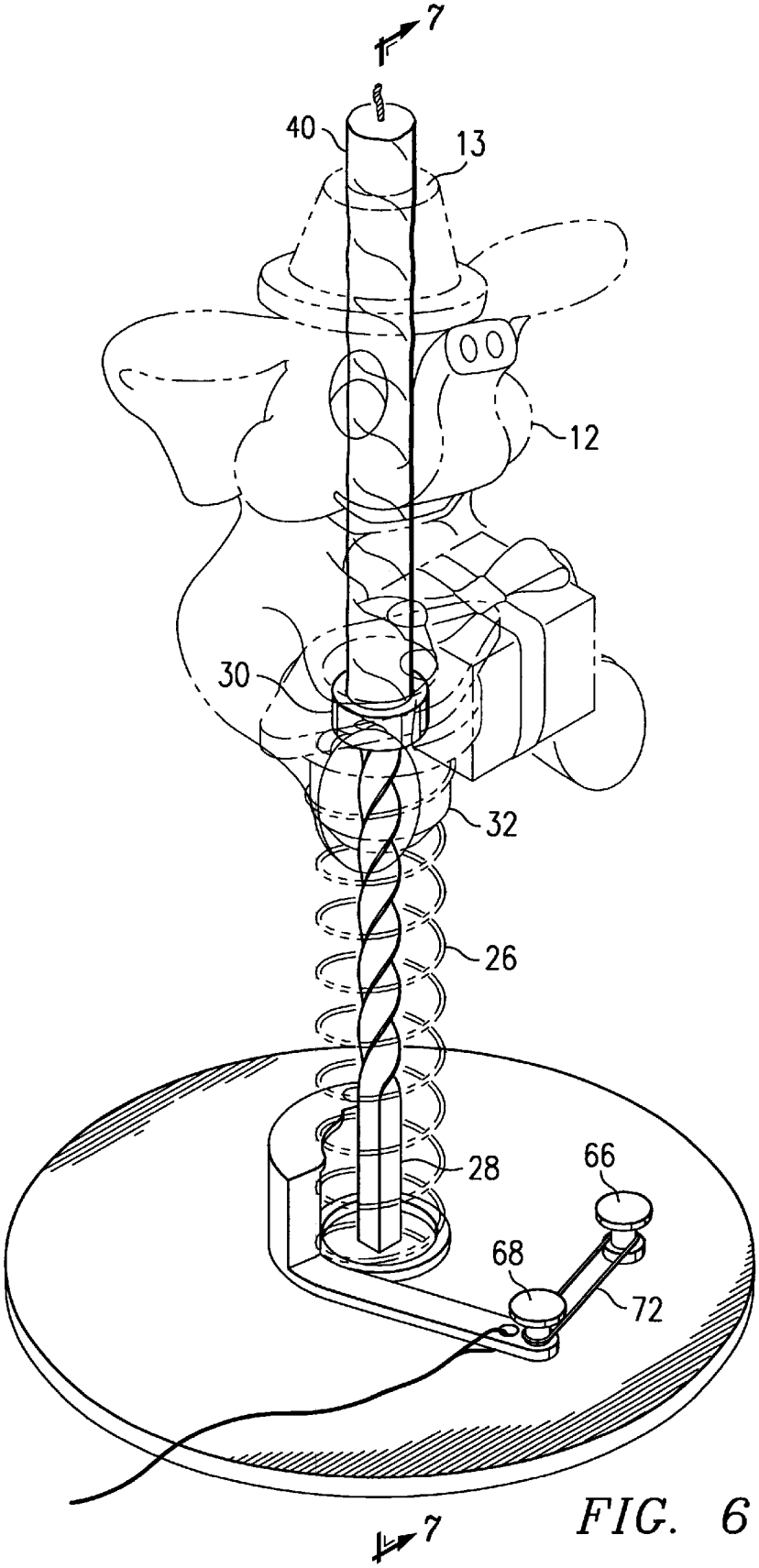
FIG. 6 is perspective view of the rod, mounting sleeve, figurine (in phantom line), and candle.

In the preferred embodiment, the rod [28] has a squared cross-section that become helical at approximately the midpoint of the rod. FIGS. 6 and 7 illustrate rod [28]. Turning to FIG. 3, the lower half of the rod [28] is unthreaded to allow the mounting sleeve [32] to travel straight up the rod [28] and pop the top [22] of the housing [18] before the mounting sleeve [32] and the figurine [12] starts spinning when it reaches the upper half of the rod [28]. The upper half of the rod [28] is threaded to force the mounting sleeve [32], and thereby the figurine [12], to spin as the mounting sleeve [32] moves beyond the unthreaded portion of the rod [28] toward the top of the rod [28].

The rod [28] preferably has a squared shaft, although a rod of any shape could be adopted, which can be attached perpendicularly to the base [16] in any manner so that the rod [28] will be secure enough to allow the mounting sleeve [32] to travel up with stability. The rod [28] could, for example, be attached to the base via a friction weld, screw, bolt, glue, staple, or split post. The rod could also be cylindrical in a constant cross-section, but that will likely diminish the spinning action of the figurine [12].

FIG. 7 is a cut-away side view along the line x—x of FIG. 6, of the inside of the pop-up device [10] in its decompressed state as shown in FIG. 3. FIG. 7 shows the preferred embodiment in which the candle [40] is inserted through the opening [13] (shown in FIG. 6) of the figurine [12]. The candle [40] then passes through the upper opening [34] of the mounting sleeve [32] and is held by the extruded end [30] of the rod [28].

In another embodiment of the pop-up device [10], the figurine [12] may be adapted to hold the candle [40] so that the opening [13] of the figurine [12] secures the candle [40]. The figurine [12] or rod [28] could also be adapted to hold more than one candle. In a further modification, the figurine [12] may be configured such that the mounting sleeve [32] and the figurine [12] form one contiguous part. This may be accomplished during molding of the figurine, by friction welding, or by other commonly known processes. In the preferred embodiment, the figurine [12] and mounting sleeve [32] are separate parts.

The extruded end [30] of the rod [28] is wider than the lower opening [35] of the mounting sleeve [32] so that the mounting sleeve [32] remains on the rod [28] when it reaches the extruded end [30]. The extruded end [30] thereby ensures safety by preventing the figurine [12] attached to the mounting sleeve [32] from flying off the end of the rod [28] and hitting a bystander.

Turning to FIG. 1, one manner in which the mounting sleeve [32] may be held in the compressed state is by a release mechanism [60] with a lip [70], which slides over the ridge [36] of the mounting sleeve [32]. The release mechanism [60] is rotatably connected to the base [16] by a pin or other hinge at the hinged end [62] of the release mechanism [60], so that the mechanism may rotate the arm [64] about the hinged end [62]. In order to allow the entire lip [70] to clear the ridge [36] at the same time during release, the arm [64] should be configured to have a decreasing radius from the outside to the hinged end [62] of the mechanism. The decreasing radius is especially useful because it allows the mounting sleeve [32] to release completely without leaning to either side. If the arm [64] did not have a decreasing radius it would likely release part of the lip [70] before the rest of the lip could clear the ridge [36]. This would likely skew the mounting sleeve [32] and figurine [12] to one side.

One skilled in the art will readily recognize that there are numerous alternative methods, which may be employed to secure and release the release mechanism [60] and thereby the mounting sleeve [32]. FIG. 4 illustrates one of many possible embodiments. The arm [64] is held in place by a latch comprising a first post [66] mounted to the base [16], a rubber band or other elastic device [72], and a second post [68] mounted to the end of arm [64] opposite the hinged end [62] of the release mechanism [60]. The rubber band [72] is placed around both posts, thereby keeping the arm [64] of the release mechanism [60] in the locked state and the lip [70] of the release mechanism [60] over the ridge [36] of the mounting sleeve [32].

The release mechanism [60] is released by a trigger mechanism, which when activated, moves the lip [70] of the release mechanism [60] off the mounting sleeve [32], thereby allowing the spring [26] to push the mounting sleeve [32] up the rod [28]. FIG. 4 illustrates one embodiment of the release line [102]. In this embodiment, trigger mechanism [100] (not shown) is a release line attached to the arm [64] of the release mechanism [60]. The release line [102] is discretely strung through or under the cake [50], so that it is hidden from view, but readily accessible to the user. Upon pulling the release line [102], the arm [64] of the release mechanism [60] is retracted, thereby sliding the lip [70] of the release mechanism [60] off the mounting sleeve [32]. One skilled in the art will recognize that the release line [102] could be made of plastic, nylon, styrene, string, or any other lightweight material. Clear or dark material, to hide the presence of the release line, is preferred.

Figure 8B:
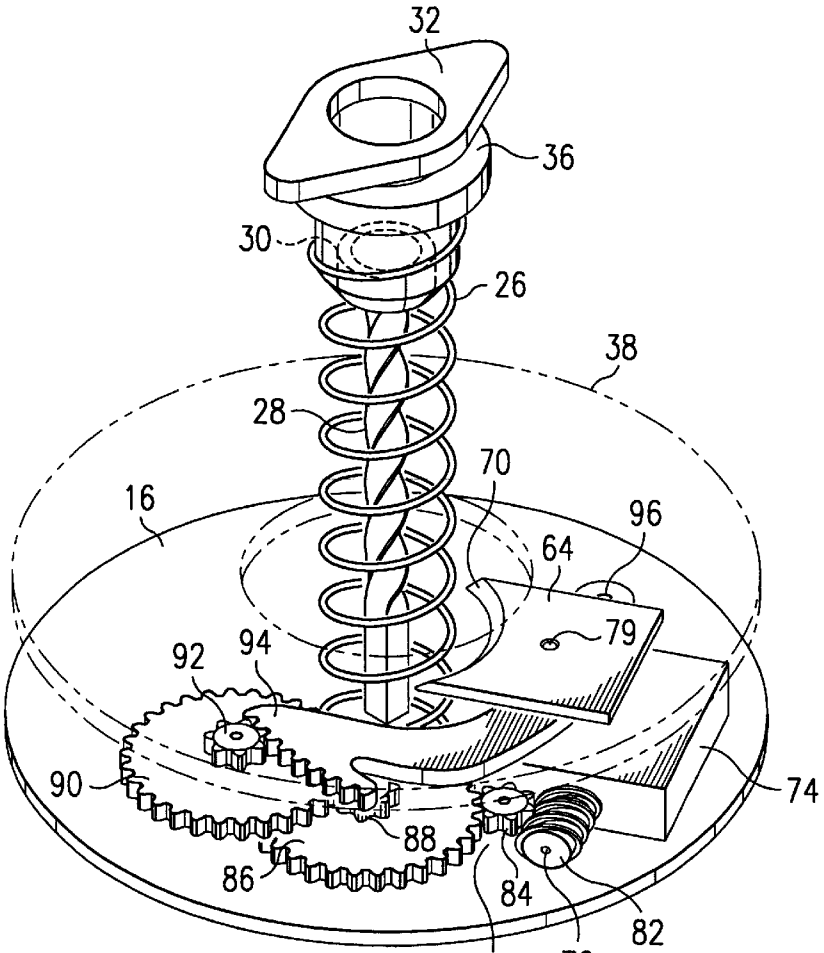
FIG. 8B is a perspective view of the device in the decompressed state showing the release mechanism with the shield in phantom line.
Figure 8A:
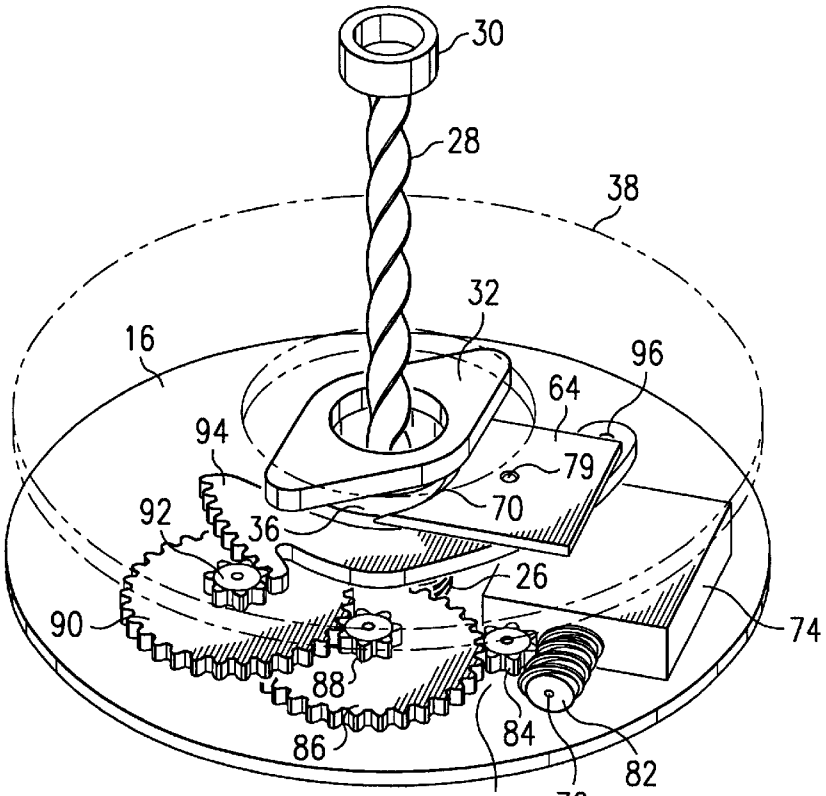
FIG. 8A is a perspective view of the pop-up device in the compressed state showing the release mechanism with the shield in phantom line.
Figure 9:
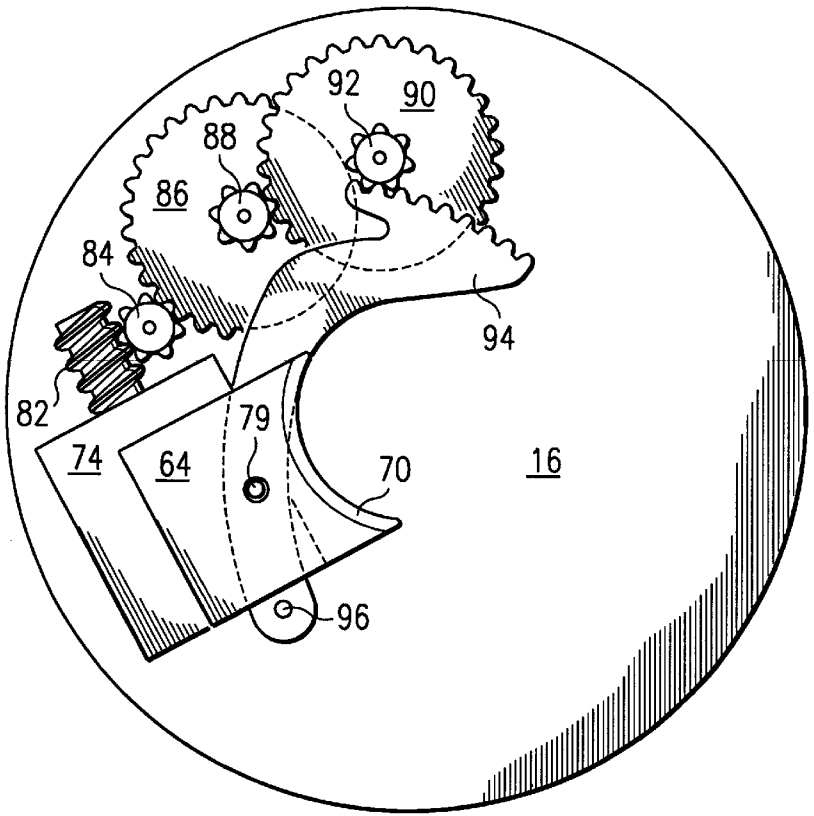
FIG. 9 is a top view of the gear and release mechanisms of one embodiment of the pop-up device.

In the preferred embodiment, a motor is used as the means for actuating the arm [64] of the release mechanism [60]. FIGS. 8A and 8B illustrate the motor [74]. The motor [74]. is adapted to include a gear mechanism [80] capable of retracting arm [64] as the motor [74] is actuated. FIGS. 8A and 8B illustrate one potential embodiment of the gear mechanism [80], which comprises several connected gears. The first gear [82] is attached to the shaft [76] of the motor [74] and is in physical contact with the second gear [84]. Additional, third [86], fourth [88], fifth [90], sixth [92], and seventh [94] gears are in mechanical communication with the second gear [84]. FIG. 9 is a top view of the release and gear mechanisms. One end of seventh gear [94] is mechanically coupled with the sixth gear [92]. The other end of the seventh gear is rotatably connected to the shield [38] or the base [16] by a pin [96]. The release mechanism arm [64] is fastened to the arm of seventh gear [94] by a pin [79]. As motor [74] is actuated, the gear mechanism [80] rotates the arm of seventh gear [94], thereby retracting the release mechanism arm [64] and releasing the mounting sleeve [32]. One skilled in the art will recognize that numerous other similar gear configurations may be used to achieve substantially the same function.

A shield [38] may be included with the device to shield the motor [74] and gear mechanism [80] from cake particles and other debris, which my fall into the housing [18] of the device after the device is activated. FIGS. 8A and 8B illustrate shield [38] in phantom line. The shield [38] may be affixed to the base [16] through pins or other similar structure perpendicular to the surface of the base [16] and shield [38]. The pins may be affixed in the same manner as the rod [28] is affixed to the base [16]. The shield [38] may also serve as a support structure for affixing other additional and optional elements to the device such as a logic circuit, power supply, and speaker. The shield may further be a complex molded part with compartments for the gears, motor, battery, speaker, light source, and logic circuit. These additions are discussed below.

In yet another embodiment, a solenoid may be used to actuate the release mechanism [60] thereby replacing the motor [74] and gear mechanism [80] by connecting the solenoid arm directly to the release arm [64] of the release mechanism [60]. One skilled in the art will appreciate that the activation function performed by the motor and solenoid could also be performed by a servomotor or other electromechanical devices and the like.

Figure 10:
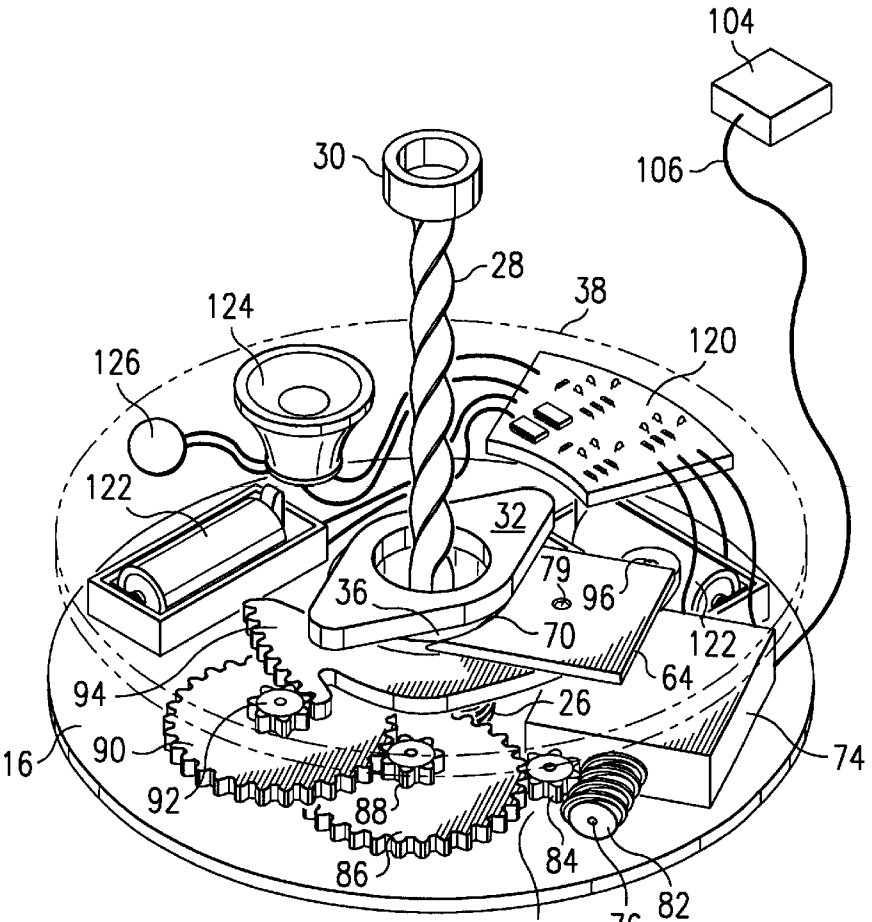
FIG. 10 is a perspective view of the base showing the release mechanism, and optional placement of the power supply, logic circuit, and speaker with the shield in phantom line.

If a motor is used in the release mechanism [60], the motor [74] may be remotely triggered using a wire [106] attached to the motor [74] and a electrical triggering device [104]. FIG. 10 illustrates the wire [106] connected to motor [74] and electrical trigger device [104]. If this method is used, the power supply [122] required to drive the motor [74] may be included in the electrical trigger device [104] or be installed under the shield [38] of the pop-up device [10]. One skilled in the art will recognize that the power supply [122] installed under the shield [38] may be easily connected electrically with the motor [74] and an optional logic circuit [120] such that upon activation of the electrical trigger device [104] the power supply [122] will drive the motor [74].

In addition to using the electrical trigger device [104], the device can be remotely activated using a standard radio frequency transmitter and receiver, an infra red transmitter and receiver, a sonic transmitter and receiver, other electromagnetic transmitting and receiving devices, or any other remote-activation device and the like commonly known in the art. Upon activating such remote trigger mechanism, the motor [74], solenoid, servomotor, or other electromechanical device is activated thereby moving the arm [64] of the release mechanism [60] and allowing the spring [26] to push the mounting sleeve [32] up the rod [28].

FIG. 2 illustrates various optional places where the sensor [108] may be placed to receive trigger signals from the transmitting trigger mechanism [100]. The sensor [108] or multiple sensors may be located on the top, side, or anywhere on the cake [50] just above or below the icing, on a candle [40], or remotely from the cake [50]. The sensor [108] is electrically connected to a commonly-available logic circuit [120] (not shown), which is connected to the motor [74] and power supply [122]. One skilled in the art will recognize that the device can easily be configured to allow for numerous sensor positions to accommodate the desired results.

FIG. 10 depicts the motor [74] coupled with optional logic circuit [120] and power supply [122]. Upon sensing an activation signal from the transmitting trigger device, the sensor [108] sends an electrical signal to logic circuit [120], which, in turn, drives the motor [74] with power supplied by the power supply [122]. Additional logic circuits may be added to the device to automatically reposition the motor [74] and gear mechanism [80] to ready them for placing the device back in the decompressed state after activation. One skilled in the art will recognize that any number of commonly available logic circuits and power supplies may be employed to achieve the described functions.

The logic circuit [120] may optionally play music or other sounds or display light from a light emitting diode or other commonly known light sources upon activation of the sensor [108] or release of the release mechanism [60]. FIG. 10 depicts an optional installation of a speaker [124] and light source [126] under the shield [38]. One skilled in the art will recognize the multitude of different sounds or music that may be played, the multitude of light that may be displayed and light sources that may be employed, and the multitude of different places the speaker and light sources may be located.

Figure 11:
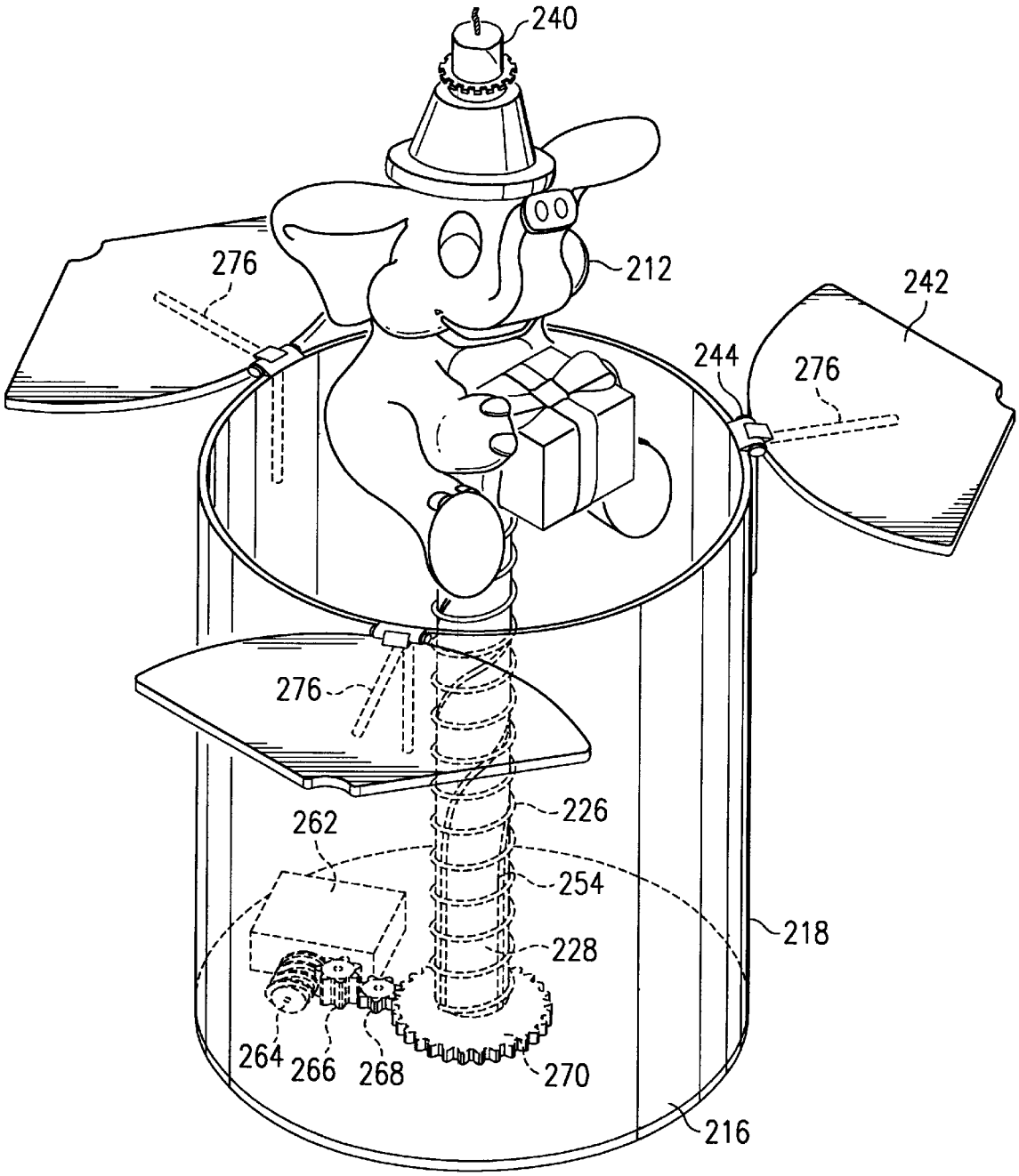
FIG. 11 is a perspective view of an alternative embodiment of the pop-up device.

In yet another embodiment of the pop-up device, the actuation of the figurine is accomplished by a drive mechanism rather than the mounting sleeve, spring, and release mechanism configuration disclosed above. FIG. 11 illustrates this embodiment. The drive mechanism [260] (not shown) comprises a motor, a gear mechanism, and a spring. Motor [262] is mounted on base [216]. The gear mechanism is mechanically coupled with motor [262] and spring [226] such that when the motor [262] is activated, the motor drives the gear mechanism, which in turn rotates the spring about rod [228].

First gear [264] is mounted on the shaft of motor [262] and coupled to second gear [266]. A worm gear and the like can be used for the first gear. The second gear [266], third gear [268], and fourth gear [270] are rotatably mounted to the base [216] such that each gear is free to rotate about its central axis. This may be accomplished in any number of ways, including by a pin mounted to the base [216]. One skilled in the art will recognize that depending on the size of the first gear and design considerations, any number of gears could be used to accomplish this function.

Figure 12:
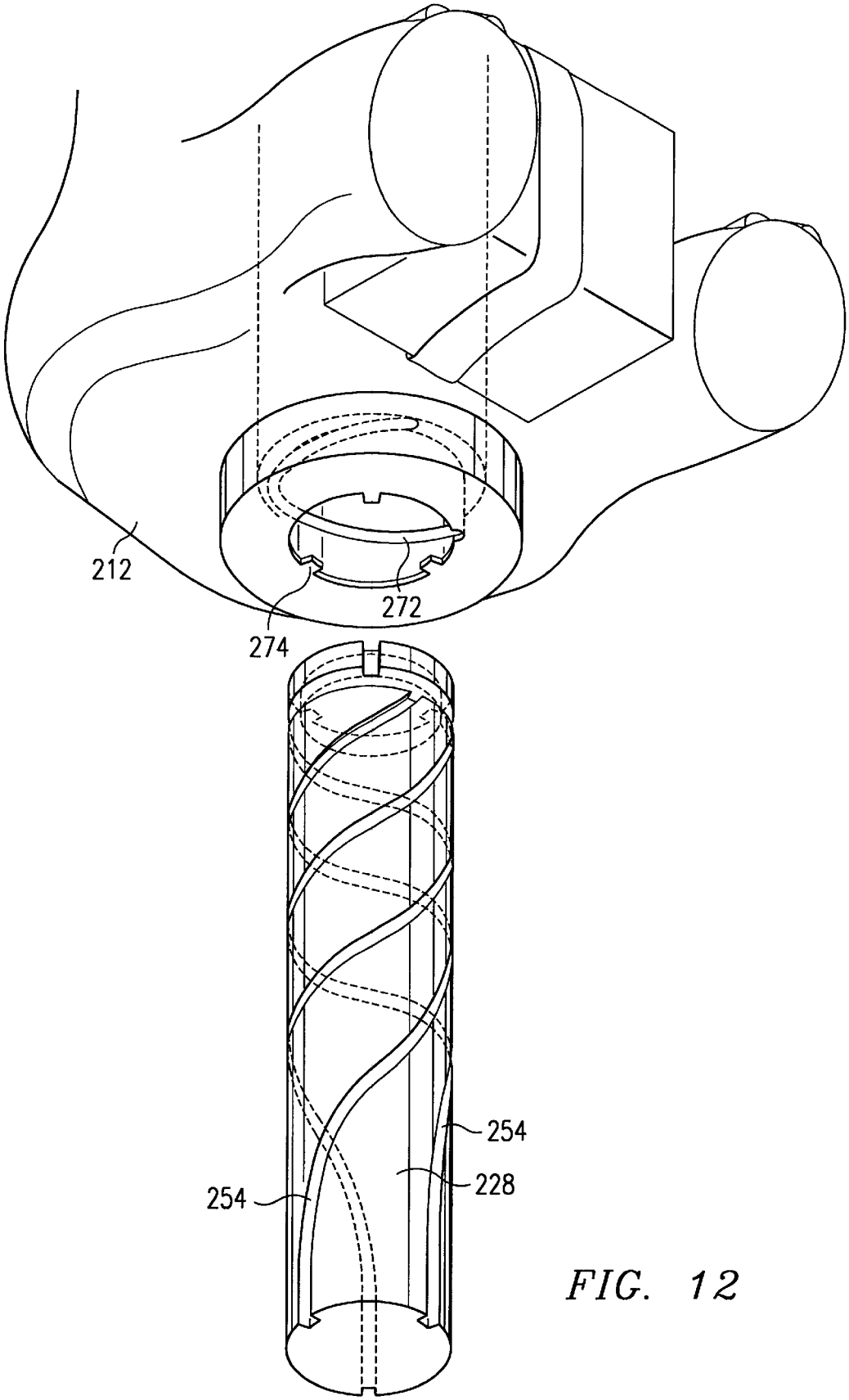
FIG. 12 is a detailed perspective view of the rod and figurine of the alternative embodiment shown in FIG. 11.

The fourth gear [270] is mechanically coupled with the spring [226], so that the spring is rotated about rod [228] as the motor [262] drives the gear mechanism. The fourth gear [270] is configured to have a hollow center section such that the gear is free to rotate about the rod [228] when driven by the motor [262]. Rod [228] is either molded with the base [216] or is mounted to the base [216] in much of the same manner as described above. FIG. 11 depicts the device in the decompressed state. To place the device in the compressed state, the figurine [212] is slipped over the rod [228] and pressed downward until it rests on the end of the rod [228] attached to the base [216]. Turning to FIG. 12, the bottom end of the figurine [212] is adapted to include a small number, such as one or two, threads or slots [272] to engage the spring [226]. As the spring [226] is rotated, it pushes the figurine [212] up the rod [228] through the top of the housing [218] and out of the cake. The figurine [212] may optionally include a mounting sleeve [232] integral to the figurine or as a part separate from the figurine but attachable to the figurine.

FIG. 11 further illustrates optional flap springs [276], which may be installed on the surface of housing [218] and flaps [242]. As the top of figurine [212] is driven through the top of housing [218] (not shown), the figurine [212] rotates the flaps [242] outward about their respective hinges [244]. The addition of flap springs [276] enhances the transition of the flaps [242] from the closed position to the open position by providing additional rotation force about the flap hinges [244], once the figurine [212] travels sufficiently up rod [228]. One skilled in the art would appreciate the number of different ways in which this function may be achieved, including the substitution of a rubber band for a spring in the flap springs.

Turning to FIG. 12, figurine [212] or optionally mounting sleeve [232] (not shown) may be modified to include one or more notches [274] on the bottom opening of the figurine [212] or mounting sleeve [232]. Each notch protrudes toward the center of the figurine from the opening. The notch is then paired with a slot [254] on rod [228] so that figurine's [212] upward movement is restricted by the pattern of the slot [254] in the rod [228]. Preferably, the slot [254] is vertical and parallel with the center axis of the rod [228] for a sufficient length to allow the figurine [212] to clear the top of the housing [218] before the slot [254] begins to curve allowing the figurine [212] to rotate about the rod [228]. Additional notches and slots may be employed to enhance this function.

The pop-up device of this embodiment may be activated by the triggering means described above. Preferably, either the electrical trigger device or the remote activation means should be employed. The device may be configured to have the power supply installed on the base [216] or it can be remote. Additionally, the device may include a logic circuit, speaker, light source, and sensor as described above. The flaps may be further configured to include retention pockets and material as disclosed above.

Figure 13:
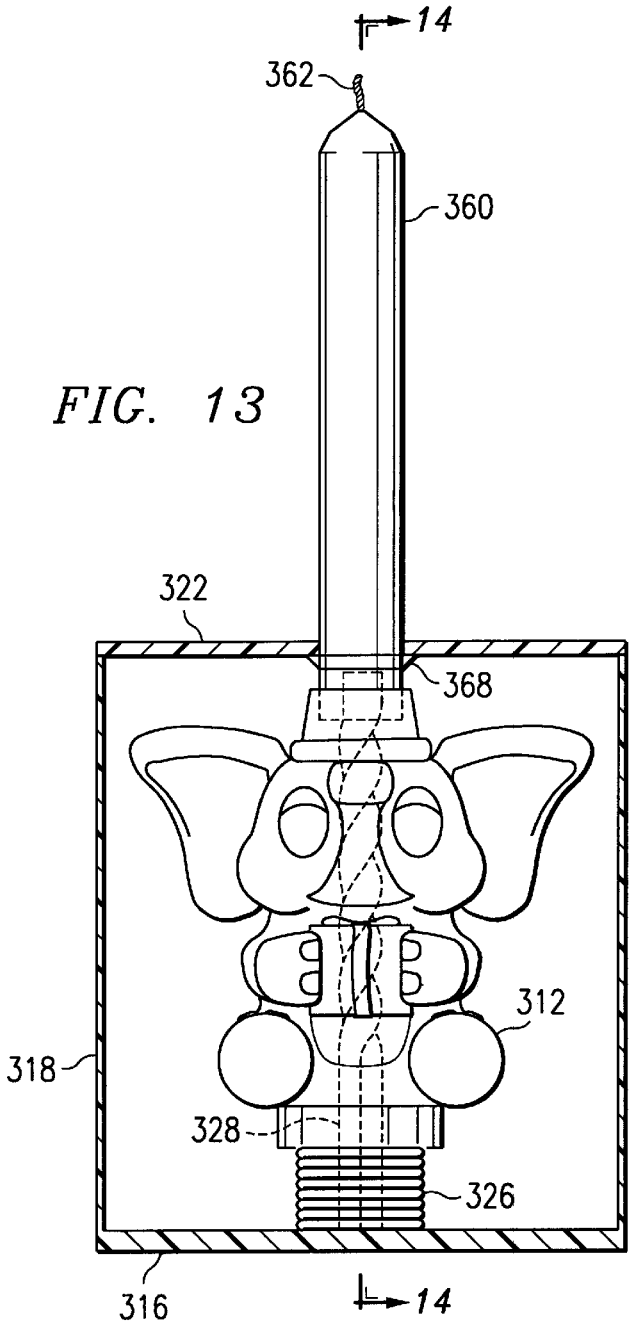
FIG. 13 is a side view of another alternative embodiment of the pop-up device.

FIG. 13 discloses yet another embodiment of the pop-up device. This configuration disposes with the need for a motor, a gear mechanism, a sensor, and the other means disclosed above. A release mechanism is integrated into a candle assembly [360] including a fuse and a notch assembly. The pop-up device is illustrated in the compresses state. Rod [328] is either affixed to the base [316] or is molded with the base. Spring [326] is threaded over the rod [328] and figurine [312] is placed over the rod [328], thereby compressing spring [326]. Top [322] of housing [318] is closed over figurine [312].

The lower portion of candle assembly [360] is slipped though an opening in top [322] of housing [318] and attached to the top of rod [328]. Notches [368] protrude from the candle assembly [360] onto the top [322] of housing [318] sufficient to hold the figurine [312] in place and compress spring [326]. Upon a controllable delay after being ignited, the wick [362] ignites a fuse, which in turn releases the notches [368], thereby allowing the figurine [312] to be forced upward by the spring [326].

Figure 14:
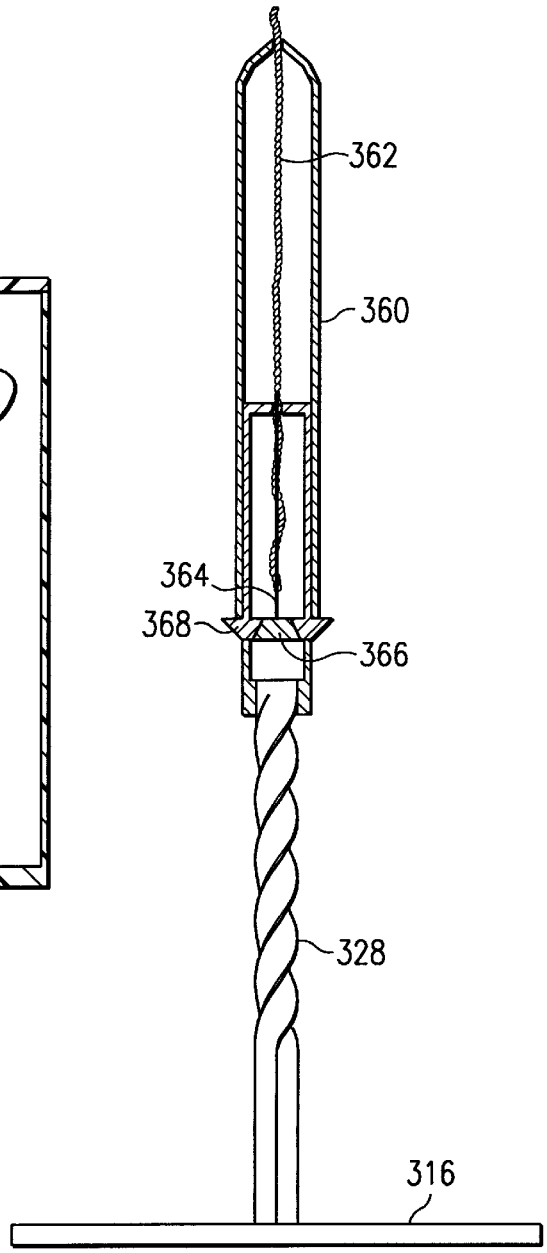
FIG. 14 is a cut-away side view along line y—y of FIG. 13.

FIG. 14 illustrates the candle assembly [360] in detail. The fuse optionally comprises a wick, release line, and plug. When the wick [362] burns a sufficient period of time, it will ignite the release line [364]. The release line [364] is preferably made of plastic, nylon, styrene, string, thread, or any other ignitable material. The release line [364] is attached at one end to the top of the candle assembly [360]. The other end of the release line [364] is attached to a plug [366] such that the release line [364] and the plug [366] are kept in tension.

Before the fuse is activated, the plug [366] exerts outward force on the notches [368], thereby retaining the figurine [312] in the compressed state. When the wick [362] burns to the release line [364], the release line [364] will release the tension on the plug [366], thereby allowing the notches [368] to move toward the center of the candle assembly [360]. Because the notches [368] no longer restrain the figurine [312], the spring [326] will force the figurine [312] up the rod [328] and through the top [322] of the housing [318]. One skilled in the art will appreciate the numerous methods that may employed to achieve the described fuse function.

The pop-up device of this embodiment may be modified to include a logic circuit, speaker, light source, and power supply as described above to play music or other sounds upon activation. The flaps may be further configured to include retention pockets and material as disclosed above.

Although the invention has been described with a certain degree of particularity, it should be recognized that elements thereof may be altered by persons skilled in the art without departing from the spirit and scope of the invention. The invention is limited only by the following claims and their equivalents.

What is claimed is:

1. A pop-up device for use in a decoration comprising:

a base;

a rod, having a first end and a second end, adapted for attachment to said base so that when said first end of said rod is secured to said base, said rod is substantially perpendicular to said base;

a spring, having a top and a bottom, capable of being threaded onto said rod so that said bottom of said spring rests on said base;

a release mechanism attached to said base;

a trigger in communication with said release mechanism;

a mounting sleeve, having an opening, a central hollow area, a top and a bottom, adapted for positioning around said rod so that said rod is threaded through said opening and said central hollow area so that said bottom of said mounting sleeve rests against said spring at the first end of the rod with said mounting sleeve being held in place by said release mechanism so that when said trigger is actuated said release mechanism moves, thereby allowing said spring to decompress and force said mounting sleeve to travel upward toward said second end of said rod; and a figurine, having a central hollow area, a top and a bottom, with said bottom of said figurine adapted for attachment to said top of said mounting sleeve.

2. The pop-up device of claim 1 further comprising a candle.

3. The pop-up device of claim 1 further comprising a housing, capable of covering said pop-up device, having a movable top.

4. The pop-up device of claim 3 wherein said movable top of said housing further comprises a plurality of flaps.

5. The pop-up device of claim 4 wherein at least one of said flaps further comprises a retention pocket.

6. The pop-up device of claim 5 further comprising glitter.

7. The pop-up device of claim 6 further comprising edible glitter.

8. The pop-up device of claim 1 wherein said mounting sleeve and said figurine form one contiguous part.

9. The pop-up device of claim 1 wherein said rod further comprises:

a smooth portion beginning at said first end of said rod; and a threaded portion extending from said smooth portion to said second end of said rod so that said figurine travels up said smooth portion of said rod and begins to spin upon reaching said threaded portion of said rod.

10. The pop-up device of claim 9 wherein said rod further comprises a squared shaft.

11. The pop-up device of claim 1 wherein said trigger is remotely activated.

12. The pop-up device of claim 11 wherein said trigger is remotely activated by a release line.

13. The pop-up device of claim 1 wherein said release mechanism further comprises a device selected from the group consisting of a motor, a solenoid, and a servomotor.

14. The pop-up device of claim 13 wherein said trigger is remotely activated.

15. The pop-up device of claim 14 wherein said trigger further comprises a sensor and a device selected from the group consisting of a radio-frequency transmitting device, an infra-red frequency transmitting device, and a sonic-frequency transmitting device.

16. The pop-up device of claim 1 further comprising a logic circuit.

17. The pop-up device of claim 1 further comprising a speaker.

18. The pop-up device of claim 1 further comprising a light source.

19. The pop-up device of claim 1 further comprising a decoration configured such that said figurine pops out of said decoration upon said trigger being actuated.

20. The pop-up device of claim 1 further comprising a cake.

21. A pop-up device for use in a decoration comprising:

a base;

a rod, having a first end and a second end, adapted for attachment to said base so that when said first end of said rod is secured to said base, said rod is substantially perpendicular to said base;

a spring, having a top and a bottom, capable of being threaded onto said rod so that said bottom of said spring rests on said base;

a release mechanism attached to said base;

a trigger, capable of being remotely activated, in communication with said release mechanism;

a mounting sleeve, having an opening, a central hollow area, a top and a bottom, adapted for positioning around said rod so that said rod is threaded through said opening and said central hollow area so that said bottom of said mounting sleeve rests against said spring at said first end of said rod with said mounting sleeve being held in place by said release mechanism so that when said trigger is actuated said release mechanism moves, they allowing said spring to decompress and force said mounting sleeve to travel upward toward said second end of said rod; and a figurine, having a central hollow area, a top and a bottom, with said bottom of said figurine adapted for attachment to said top of said mounting sleeve;

a candle;

a housing, capable of covering said pop-up device, having a movable top and a plurality of flaps; and a cake.

22. The pop-up device of claim 21 wherein said release mechanism further comprises a device selected from the group consisting of a motor, a solenoid, and a servomotor.

23. The pop-up device of claim 21, wherein said trigger further comprises a sensor and a device selected from the group consisting of a radio-frequency transmitting device, an infra-red frequency transmitting device, and a sonic-frequency transmitting device.

24. The pop-up device of claim 21 wherein at least one of said flaps further comprises a retention pocket.

25. The pop-up device of claim 24 further comprising edible glitter.

26. A pop-up device for use in a decoration comprising:

a base;

a rod, having a first end and a second end, adapted for attachment to said base so that when said first end of said rod is secured to said base, said rod is substantially perpendicular to said base;

a spring, having a top and bottom, said bottom of said spring attached to said base and said spring threaded over said rod;

a figurine, having a central hollow area, a top and a bottom, with said bottom of said figurine adapted for attachment to said top of said spring;

a housing, having a top and bottom, capable of covering said base, rod, spring, and figurine, having a movable top and a central open area, and adapted to hold said figurine in place until released by the release mechanism;

a release mechanism attached to said top of said housing;

a candle assembly, having a first and second end, said first end adapted for a wick and said second end attached to said top of said housing; and a fuse, having a first and second end, said first end attached to said wick and said second end attached to said release mechanism.

27. The pop-up device of claim 26 wherein said movable top of said housing further comprises a plurality of flaps.

28. The pop-up device of claim 26 wherein at least one of said flaps further comprises a retention pocket.

29. The pop-up device of claim 28 further comprising glitter.

30. The pop-up device of claim 28 further comprising edible glitter.

31. The pop-up device of claim 26 further comprising a decoration configured such that said figurine pops out of said decoration upon said trigger being actuated.

32. The pop-up device of claim 26 further comprising a cake.

33. A pop-up device for use in a decoration comprising:

a base;

a rod, having a first end and a second end, adapted for attachment to said base so that when said first end of said rod is secured to said base, said rod is substantially perpendicular to said base;

a spring, having a top and a bottom, capable of being threaded onto said rod so that said bottom of said spring rests on said base;

a release mechanism attached to said base;

a trigger in communication with said release mechanism; and a mounting sleeve, having an opening, a central hollow area, a top and a bottom, adapted for positioning around said rod so that said rod is threaded through said opening and said central hollow area so that said bottom of said mounting sleeve rests against said spring at the first end of the rod with said mounting sleeve being held in place by said release mechanism so that when said trigger is actuated said release mechanism moves, thereby allowing said spring to decompress and force said mounting sleeve to travel upward toward said second end of said rod.

34. The pop-up device of claim 33 further comprising a housing, capable of covering said pop-up device, having a movable top.

35. The pop-up device of claim 34 wherein said movable top of said housing further comprises a plurality of flaps.

36. The pop-up device of claim 33 wherein said trigger is remotely activated.

* * * * *